US006243915B1

(12) United States Patent
Nakai et al.

(10) Patent No.: US 6,243,915 B1
(45) Date of Patent: Jun. 12, 2001

(54) VACUUM CLEANER

(75) Inventors: Kouichi Nakai, Himeji; Toshinari Kobayashi, Ono; Sadaki Kodera, Kasai; Yoshihiro Mori, Kasai; Toshiyuki Fujiyoshi, Kasai; Takahiro Nishiyama, Kasai, all of (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 09/524,788

(22) Filed: Mar. 13, 2000

(30) Foreign Application Priority Data

Mar. 15, 1999 (JP) ..... 11-067863
Mar. 17, 1999 (JP) ..... 11-071585

(51) Int. Cl.[7] ..... A47L 5/14
(52) U.S. Cl. ..... 15/346; 174/47
(58) Field of Search ..... 15/346, 322; 174/47

(56) References Cited

U.S. PATENT DOCUMENTS 2,012,640 * 8/1935 Shipman ..... 15/346
2,064,344 * 12/1936 Good ..... 15/346
3,461,478 * 8/1969 Taylor ..... 15/346 X
4,316,304 * 2/1982 Parise et al. ..... 15/339
5,400,462 * 3/1995 Amoretti ..... 15/322 X
5,459,901 * 10/1995 Blase et al. ..... 15/322 X
5,647,092 * 7/1997 Miwa ..... 15/346

FOREIGN PATENT DOCUMENTS

972510 * 8/1975 (CA) ..... 15/346
2218351 * 11/1973 (DE) ..... 15/346
1542802 * 9/1968 (FR) ..... 15/346
553076 * 12/1956 (IT) ..... 15/346

* cited by examiner

*Primary Examiner*—Chris K. Moore
(74) *Attorney, Agent, or Firm*—Sughrue, Mion, Zinn, Macpeak & Seas, PLLC

(57) ABSTRACT

A vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow. The pipe is composed of an inner cylindrical portion having a substantially circular section and forming the suction air passage, and an outer cylindrical portion a part of which is uniformly formed with the inner cylindrical portion and which covers the inner cylindrical portion to form the exhaust air passage. There can be achieved for a light-weighted and slim-sized arrangement of the pipe through which the suction air passage and the exhaust air passage extends without the fear of dust plugging, and a vacuum cleaner of exhaust circumfluently flowing type can be easily put into to practice.

8 Claims, 12 Drawing Sheets

3
3a
3b
31
32
33
34
34a
35
A
B
I
II

VACUUM CLEANER

BACKGROUND OF THE INVENTION

The present invention relates to a vacuum cleaner, and particularly to a vacuum cleaner of exhaust circumfluently flowing (circulation) type for making air exhausted from a motor fan incorporated in a vacuum cleaner main body circumfluently flow into, for instance, a suction nozzle for floors through a hose and a pipe.

In a general vacuum cleaner of floor moving type, air exhausted from a motor fan incorporated in a vacuum cleaner main body is entirely exhausted to the exterior through an exhaust outlet which is formed, for instance, at a rear surface side of the main body.

That is, dust which is sucked with air through a suction nozzle for floors is taken into the vacuum cleaner main body via a pipe and a hose, and air which has been removed of dust through a paper package or the like and used for cooling a motor of the motor fan is exhausted to the exterior through the exhaust outlet thereafter. At this time, since all of the exhaust air from the motor fan is exhausted, air is blown out to the exterior at a remarkable speed. Therefore, there is presented a drawback that dust deposited on a floor surface or on a carpet is whirled up through this exhaust air to be dispersed all over the room.

As disclosed in Japanese Examined Utility Model Publication No. 36553/11964 or in Japanese Unexamined Patent Publication No. 135795/11997, there are known vacuum cleaners which are provided for the purpose of reducing exhaust air blown out to the exterior in this manner or of improving dust-collecting effects wherein hoses, pipes and suction nozzle which are connected to vacuum cleaner main bodies are formed with suction air passages as well as exhaust air passages for making a part of or the entire air exhausted from motor fans circumfluently flow.

In such vacuum cleaners, hoses as well as pipes are arranged to be of concentric circular double structures wherein suction air passages are formed at inner sides while exhaust air passages are formed at outer sides.

However, in such vacuum cleaners of exhaust circumfluently flowing type, drawbacks are presented due to the arrangement of the concentric circular double structure of the pipe as well as the necessity of utilizing interstitial materials for maintaining outer and inner pipes in concentric circular conditions, so that excessive weight and thickness lead to inferior operatability and difficulty in practical use.

While there might be considered to separate an interior of a general pipe used for suction of air only by means of a plate-like partition to form an suction air passage and an exhaust air passage, the suction air passage will accordingly assume a semicircular section so that dust is more likely to be plugged when compared to general passages of circular shapes.

Further, while exhaust air is made to pass through an outer passage of the double structure in the arrangement of the prior art, air which is exhausted from the motor fan is heated by cooling the motor so that in case such an exhaust air passes through the outer exhaust air passage of the double structured pipe, an outer surface temperature of the pipe will be increased to result in drawbacks in view of usage.

Moreover, the hose needs to be of a double structure type in such exhaust circumfluently flowing type vacuum cleaners. However, in vacuum cleaners, there are generally employed hoses which are called one-layer and two-wiring hoses and are relatively heavy hoses incorporating therein coil wiring exhibiting conductive (so that they can be used as signal wiring) and shape-retaining characteristics. Therefore, in case of employing a double structure with such a hose, the weight of the entire hose will become excessive and results in inferior operatability and difficulty in practical use.

Further, while connecting pipes for attaching a hose to a hose-inserting inlet of the vacuum cleaner main body and a hose grip portion are attached to both ends of the hose, a hose, like an one-layer and two-wiring hose, which incorporates therein coil wiring needs to be attached and fixed to an hose-installing end of the connecting pipe in a screwing manner, and performing this operation at both ends of the double structured hose twice each, that is, four times, is quite troublesome. Further, attaching and fixing needs to be performed while taking torsions in the hose into consideration. Thus, assembling processes of the hose become quite complicated.

Moreover, deformations might sometimes remain in hoses incorporating therein coil wiring such as one-layer and two-wiring hoses when erroneously treading thereon. In case only the inner hose is deformed in a double structure hose, such a deformation cannot be recognized from its external appearance, and the plugging of dust is apt to happen.

The present invention has been made for solving such problems, and it is an object of a first invention to achieve for a light-weighted and slim-sized pipe of an exhaust circumfluently flowing type vacuum cleaner through which a suction air passage and an exhaust air passage extend.

It is an object thereof to restrict increases in temperature on an outer surface of the pipe owing to heat of exhaust air.

It is an object of a second invention to achieve for a light-weighted double structure hose of an exhaust circumfluently flowing type vacuum cleaner through which a suction air passage and an exhaust air passage extend.

It is an object thereof to simplify assembling processes of the hose and to make deformations of an inner hose visible from its external appearance.

SUMMARY OF THE INVENTION

A first invention relates to a vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow, characterized in that the pipe is composed of an inner cylindrical portion having a substantially circular section and forming the suction air passage, and an outer cylindrical portion a part of which is uniformly formed with the inner cylindrical portion and which covers the inner cylindrical portion to form the exhaust air passage.

The invention is further characterized in that the exhaust air passage of the pipe is formed to assume a substantially crescent section and in that the outer cylindrical portion of the pipe is formed to assume a substantially circular section.

The invention is further characterized in that a wall thickness of a partition portion for separating the air suction air passage and the exhaust air passage of the pipe is formed to be smaller than an outer wall portion of the pipe.

The invention is further characterized in that a partition portion for separating the suction air passage and the exhaust air passage at at least one of a suction inlet side of the pipe and a suction inlet of a grip portion of the hose is indented in a depth direction by a specified distance.

A second invention relates to a vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow, characterized in that the hose is arranged to be of a double structure, and in that a flexible hose incorporating therein conductive wiring is used as an outer hose for forming the exhaust air passage, while a flexible hose incorporating no conductive wiring is used as an inner hose for forming the suction air passage.

Further, the invention relates to a vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow, characterized in that the hose is arranged to be of a double structure and, in that a flexible hose incorporating therein a shape-retaining means is used as an outer hose for forming the exhaust air passage, while a flexible hose incorporating no shape-retaining means is used as an inner hose for forming the suction air passage.

The invention is further characterized in that an inner hose-installing end of a connecting pipe of double structure, which is used for attaching one end of the hose of double structure to a hose-inserting inlet of the vacuum cleaner main body and the other end thereof to a hose grip portion, is made to extrude outwardly than an outer hose-installing end.

The invention is further characterized in that the vacuum cleaner includes, in addition to a connecting pipe of double structure, which is used for attaching one end of the hose of double structure to a hose-inserting inlet of the vacuum cleaner main body and the other end thereof to a hose grip portion, an auxiliary pipe which is installed to at least one end of the inner hose and which is tightly fitted to a corresponding inner hose-installing end of the connecting pipe, and a slip off-preventing mechanism for the tightly fitted auxiliary pipe.

The invention is further characterized in that the vacuum cleaner includes, as the slip off-preventing mechanism, an annular groove formed at an outer periphery of a fitting portion of the auxiliary pipe and an engaging member attached to the inner hose-installing end of the connecting pipe for engaging with the annular groove, wherein the auxiliary pipe attached to the inner hose and the inner hose-installing end of the connecting pipe are connected in a slidable manner in a peripheral direction.

The invention is further characterized in that the inner hose is made to be opaque while the outer hose is made to be transparent.

The invention is further characterized in that the pipe according to the second invention is composed of an inner cylindrical portion having a substantially circular section and forming the suction air passage and of an outer cylindrical portion a part of which is uniformly formed with the inner cylindrical portion and which covers the inner cylindrical portion to form the exhaust air passage.

The invention is further characterized in that the exhaust air passage of the pipe according to the second invention is formed to assume a substantially crescent section and in that the outer cylindrical portion of the pipe is formed to assume a substantially circular section.

DETAILED DESCRIPTION

One embodiment according to the present invention will now be explained in details with reference to the FIGS. 1 to 8.

Figure 1:
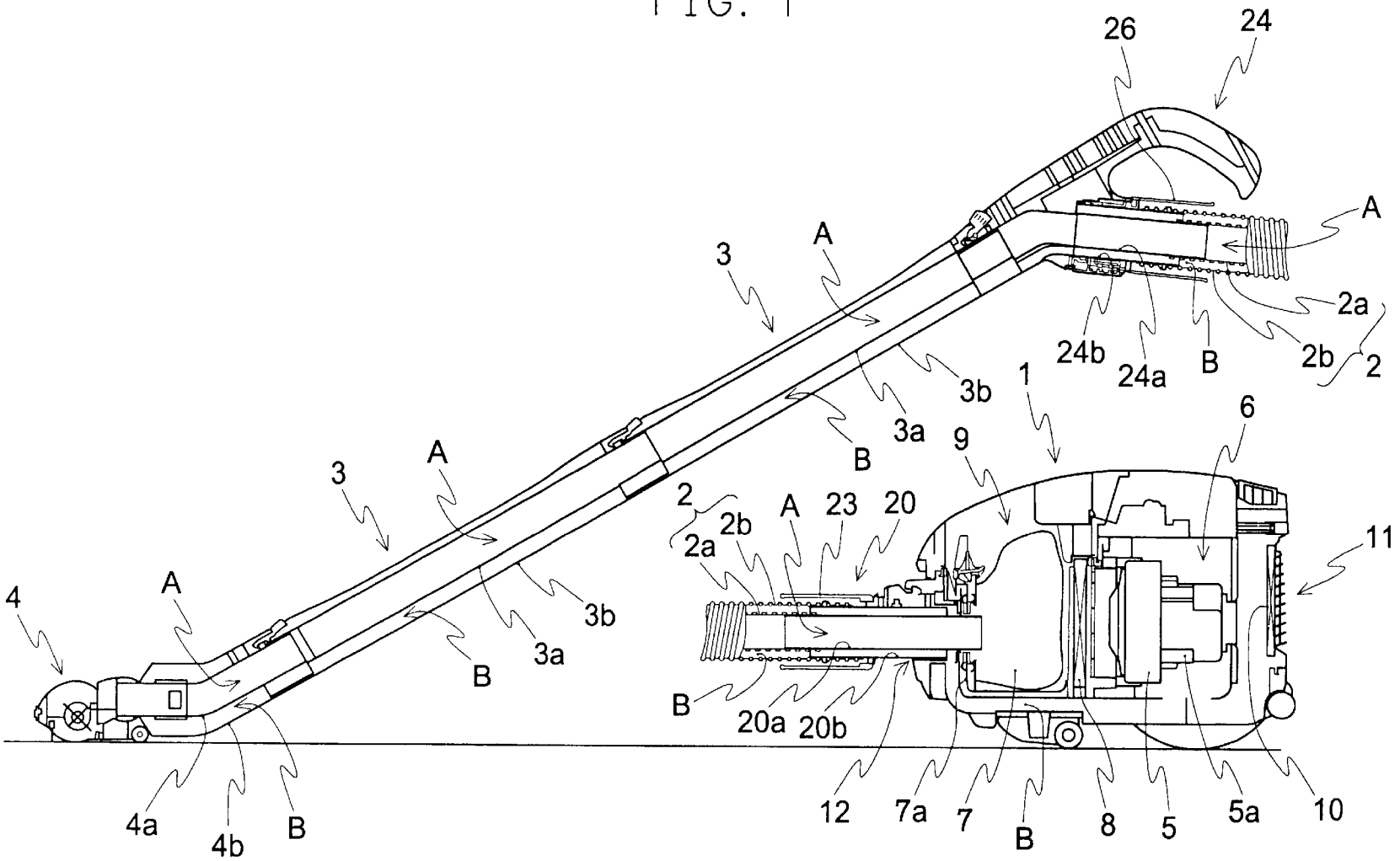
FIG. 1 is an overall structural view showing an embodiment wherein the present invention is applied to a general vacuum cleaner of floor moving type, while an intermediate portion of a hose is omitted in the drawing for purpose of convenience.

The vacuum cleaner of floor moving type to which the present invention is applied is composed of, as shown in FIG. 1, a vacuum cleaner main body 1, a hose 2, connecting pipes 3 and a suction nozzle for floors 4 and others.

The vacuum cleaner main body 1 incorporates therein a motor chamber 6 accumulating a motor fan 5 for suction purposes, and a dust-collecting chamber 9 using a paper pack 7 and a minute dust filter 8.

On a rear surface side of the vacuum cleaner main body 1, there is formed an exhaust outlet 11 for discharging a part of air exhausted from the motor fan 5 to the exterior via an exhaust filter 10.

Further, passages of a part of the vacuum cleaner main body 1, the hose 2, the connecting pipes 3 and the suction nozzle for floors 4 are arranged to be of double structure. The passages of the above members are separated into a suction air passage A and an exhaust air passage B, and the members are in communication with each other.

That is, the exhaust air passage B is formed at a lower portion side of the dust-collecting chamber 9 and the motor chamber 6 of the vacuum cleaner main body 1 for making a part of air exhausted from the motor fan 5 circumfluently flow wherein this exhaust air passage B is communicated to an exhaust air passage B of a hose joint portion 20 which is attached to a hose inserting inlet 12 of the vacuum cleaner main body 1.

The hose joint portion 20 has a double structure in which connecting pipes 20*a*, 20*b* are arranged concentrically, and both ends of the inner connecting pipe 20*a* forming the suction air passage A are arranged in an extruding manner wherein one end thereof is inserted into an installing portion 7*a* of a paper pack 7 and the exhaust air passage B formed by the outer connecting pipe 20*b* is communicated to the exhaust air passage B in the main body 1.

To the other end side of the connecting pipe 20*a*, 20*b*, there is attached one end of the hose 2 of double structure. The hose 2 is so arranged that a flexible hose 2*a*, which is denoted as a conduit hose and is similar to a drain hose for a washing machine, is used at its inner side and that a flexible hose 2*b*, which is denoted as an one-layer and two wiring hose incorporating therein coil wiring 21 for providing conductive (e.g. signal wiring) and shape-retaining characteristics as generally used in a vacuum cleaner, is used at its outer side. Since the conduit hose 2*a* does not incorporate therein coil wiring 21 unlike the one-layer and two-wiring hose 2*b*, it is light-weighted and is restorable without leaving deformations even if it is erroneously treaded on unlike the one-layer and two-wiring hose 2*b*.

Figure 5A:
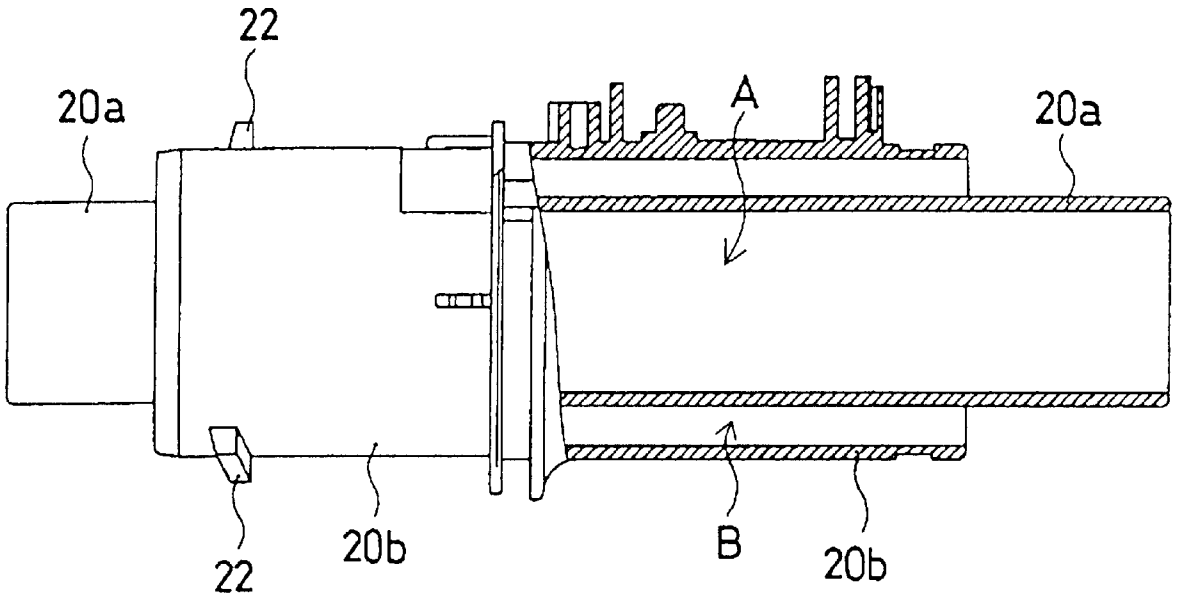
FIGS. 5(*a*) and 5(*b*) are structural views of a connecting pipe of the hose joint portion shown in FIG. 4 wherein FIG. 5(*a*) is a side view partially shown as a notched sectional view, and FIG. 5(*b*) an end surface view at one end side to which the hose is connected.
Figure 5B:
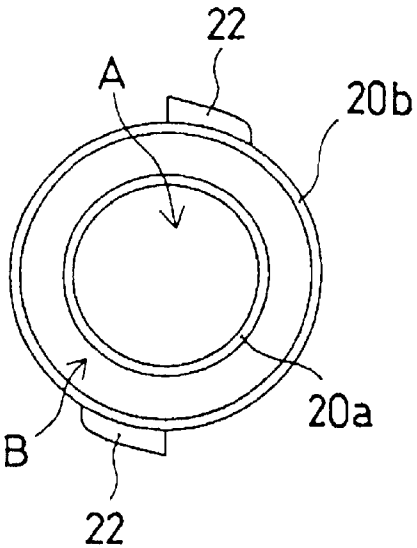
Figure 6:
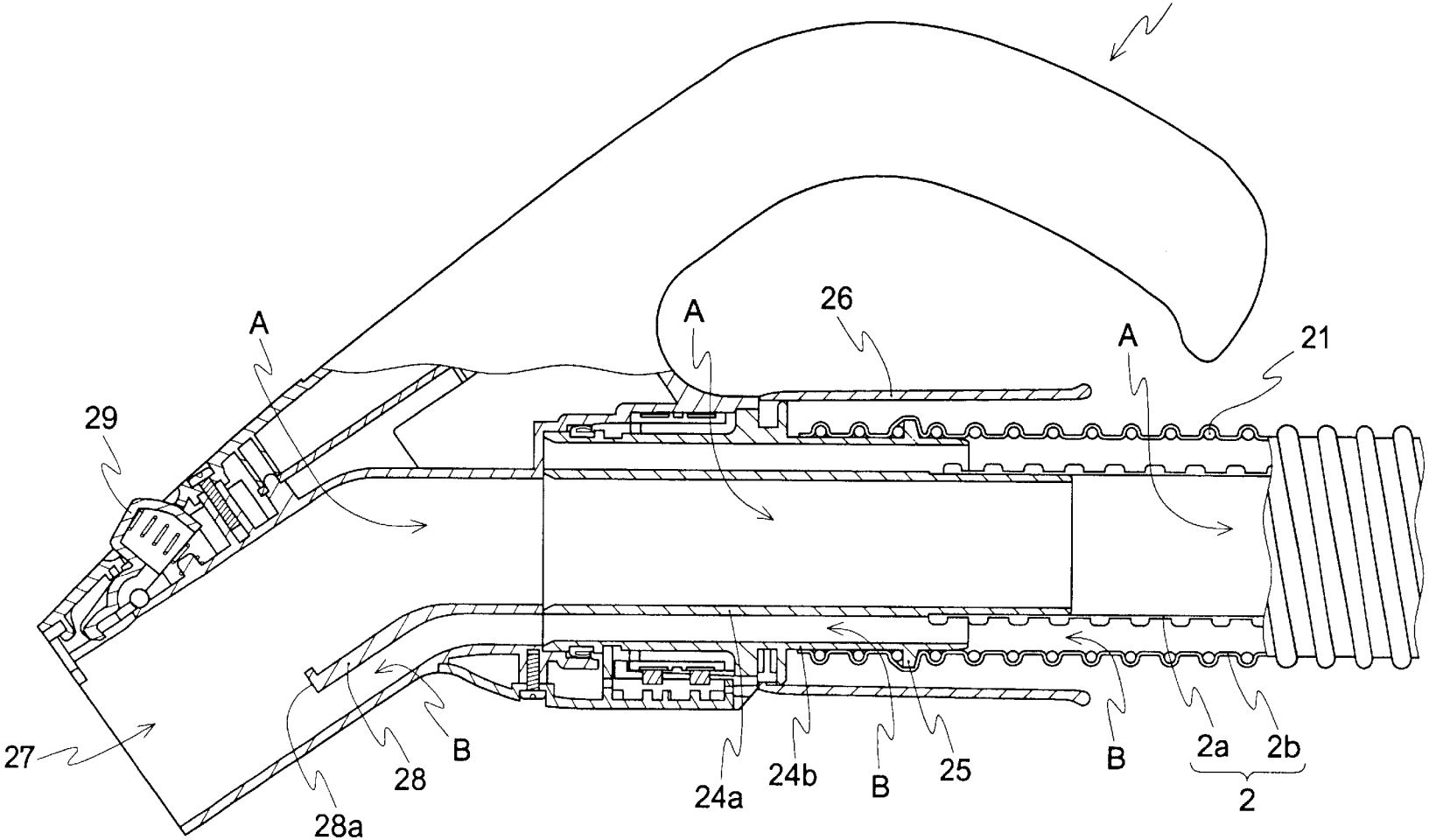
FIG. 6 is an enlarged view of a hose grip portion shown in FIG. 1.

The hose 2 is attached and fixed in such a manner that the inner conduit hose 2*a* is first attached and adhered to an extruding end of the inner connecting pipe 20*a* of the joint portion 20 whereupon the outer one-layer and two-wiring hose 2*b* is screwed into a rib 22 which is formed at an outer surface of the outer connecting pipe 20*b* in a threaded manner as shown in FIG. 5. An installing portion of the hose 2 is covered by a cylindrical protecting cover 23.

Figure 7B:
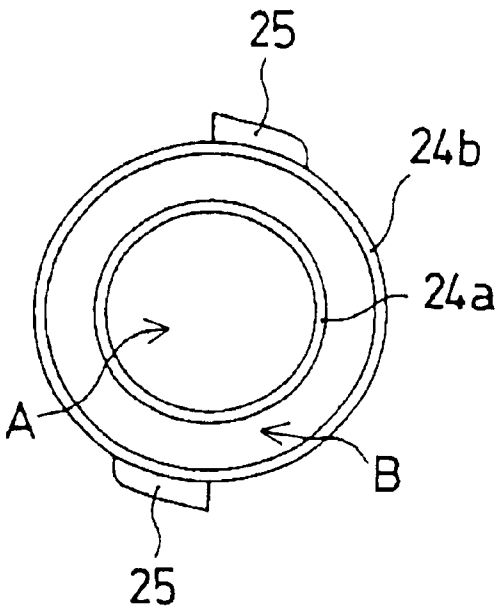
FIGS. 7(*a*) and 7(*b*) are structural views of a connecting pipe of the hose grip portion shown in FIG. 6 wherein FIG. 7(*a*) is a side view, and FIG. 7(*b*) an end surface view at one end side to which the hose is connected.
Figure 7A:
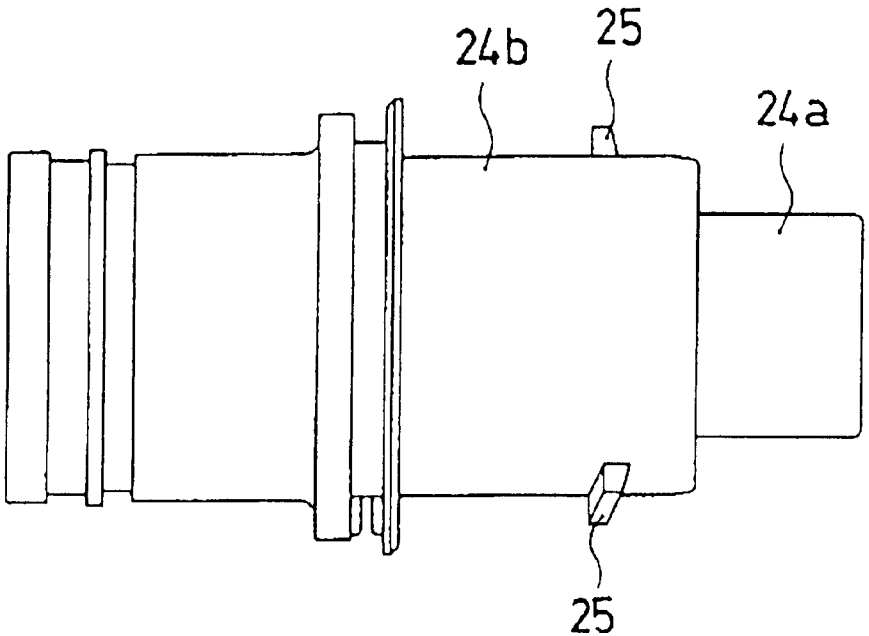

The other end of the hose 2 is attached and fixed to a grip portion 24 for performing operations at hand in a similar manner as above-described via connecting pipes 24*a*, 24*b*. That is, the inner conduit hose 2*a* is first attached and adhered to an extruding end of the inner connecting pipe 24*a* whereupon the outer one-layer and two-wiring hose 2*b* is screwed into a rib 25 that is formed at an outer surface of the outer connecting pipe 24*b* in a threaded manner as shown in FIG. 7. An installing portion of this hose 2 is similarly covered by a cylindrical protecting cover 26.

The grip portion 24 so arranged that a partition portion 28 for separating the suction air passage A and the exhaust air passage B at a suction inlet 27 to which the connecting pipe 3 is attached is spaced inwardly from the section inlet end by a specified distance. At an upper portion of the suction inlet 27, there is provided a clamp 29 for attaching and fixing the connecting pipe 3.

It should be noted that the inner and outer connecting pipes 20*a*, 20*b* at the hose joint portion 20 and the inner and outer connecting pipes 24*a*, 24*b* at the grip portion 24 are respectively partially connected by means of a rib (not shown) to assume a concentric circular double structure.

Figures 2A, 2B, 2C, 2D, 2E, 2F:
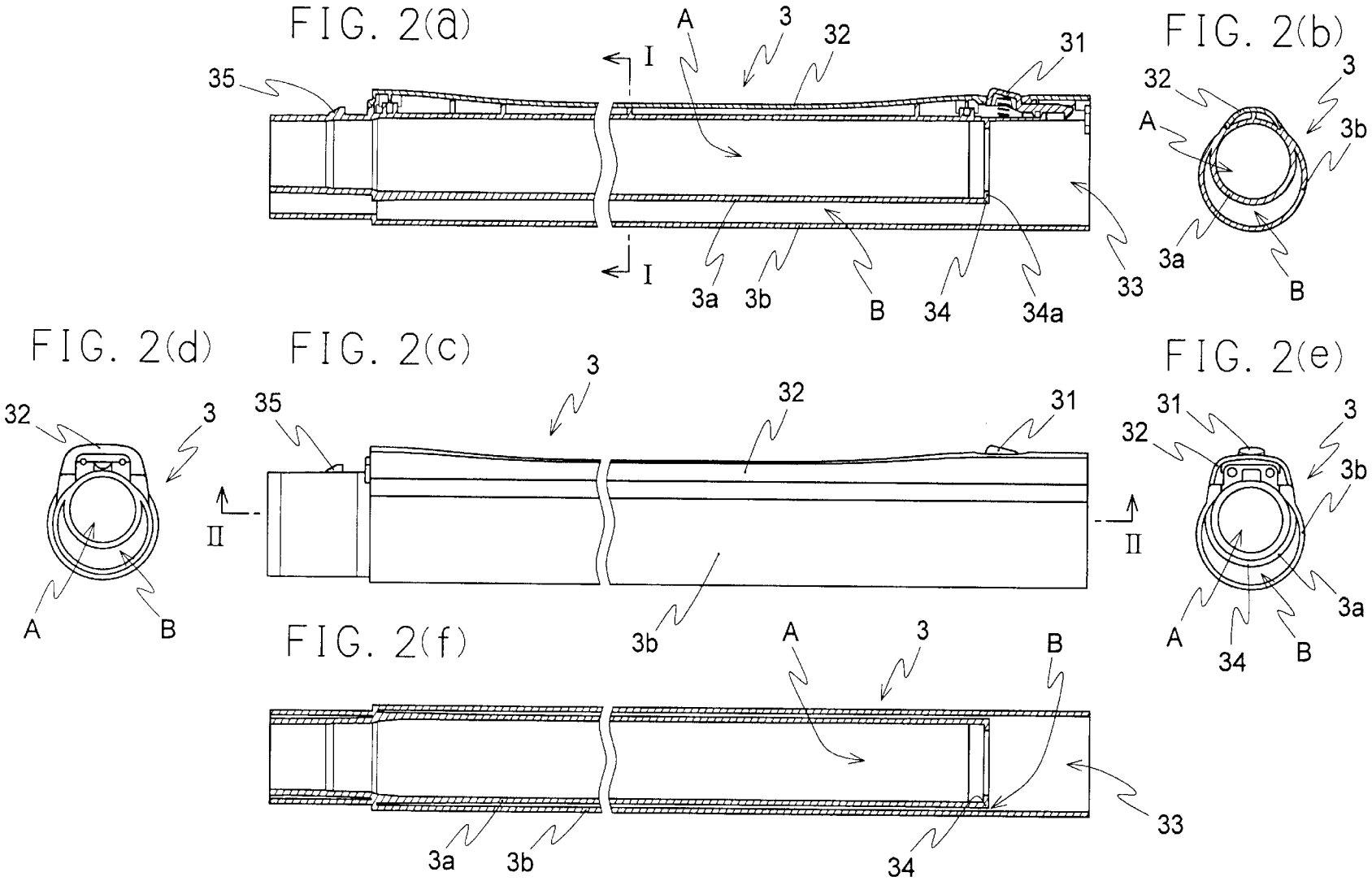
FIGS. 2(*a*) to 2(*f*) are structural views of a connecting pipe of the embodiment shown in FIG. 1 wherein FIG. 2(*a*) is a longitudinal sectional view, FIG. 2(*b*) a sectional view taken along the line I—I of FIG. 2(*a*), FIG. 2(*c*) a side view, FIG. 2(*d*) an end surface view at one end side of FIG. 2(*c*), FIG. 2(*e*) an end surface view at the other end side thereof, and FIG. 2(*f*) a sectional view taken along the line II—II of FIG. 2(*c*)
Figure 3:
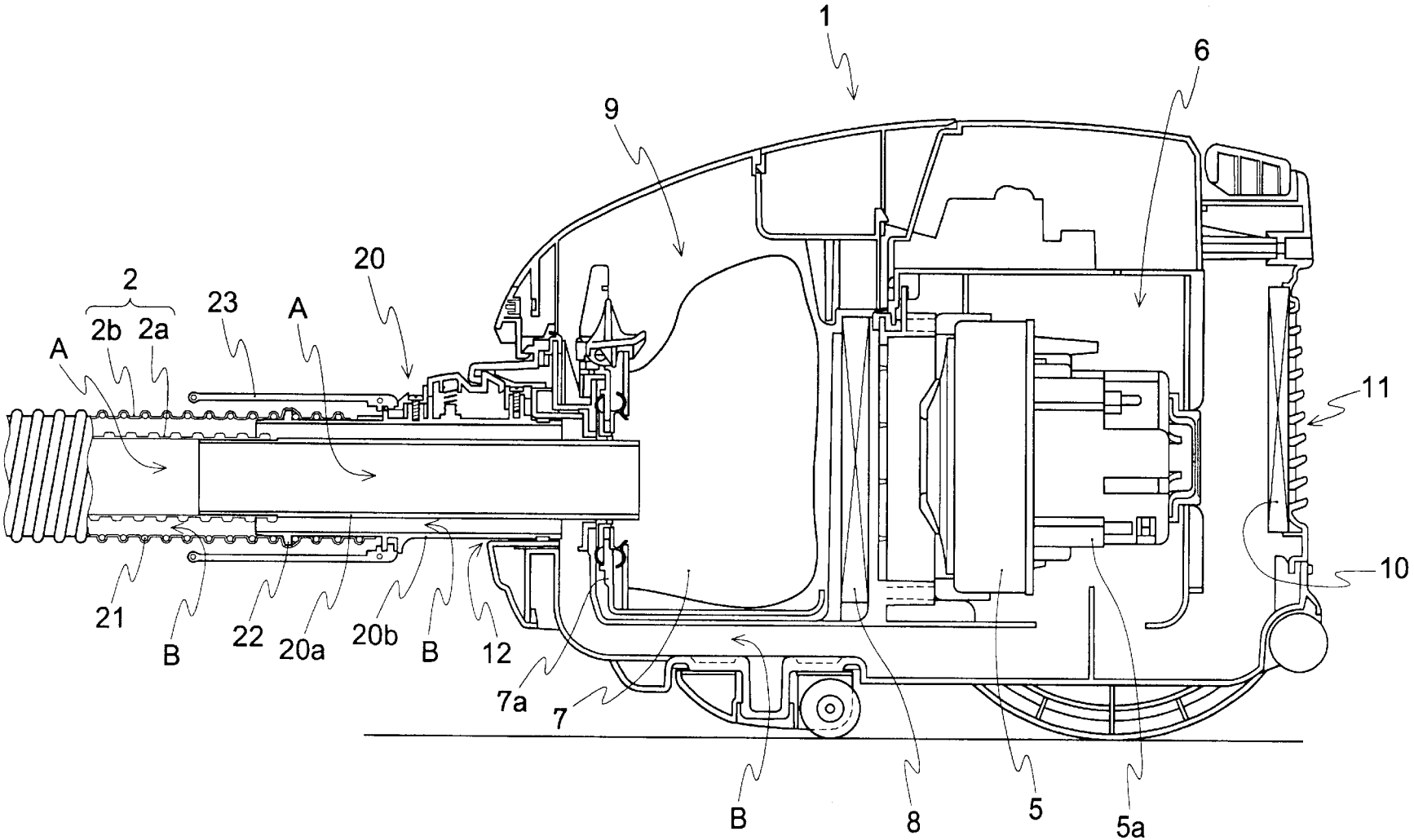
FIG. 3 is an enlarged sectional view of a main body of the vacuum cleaner and a hose joint portion shown in FIG. 1.

One the other hand, the connecting pipes 3,3 are respectively composed, as shown in FIG. 2, of an inner cylindrical portion 3*a* having a substantially circular section for forming a suction A and an outer cylindrical portion 3*b* an upper portion of which is uniformly formed with the inner cylindrical portion 3*a* and which covers the inner cylindrical portion 3*a* to form an exhaust air passage B.

Exhaust air which passes through the exhaust air passage B is clean air of which dust has been eliminated via the paper pack 7 and the minute dust filter 8 of the vacuum cleaner main body 1, and in view of the point that the exhaust air passage does not need to assume a substantially circular section for coping with plugging of dust as it is the case with the inner cylindrical portion 3*a*, the exhaust air passage B of the present embodiment assumes a substantially crescent section and the outer cylindrical portion 3*b* is formed to assume a substantially circular section.

With this arrangement, it can be achieved for a light-weighted and slim-sized structure owing to the uniformly formed upper portion and, moreover, for a substantially circular section of both the inner and outer pipes so that operatability can be improved without affecting its strength. Therefore, the connecting pipe 3 according to the present embodiment is capable of achieving a substantially identical shape and operatability with no sense of incompatibility even when compared with a conventional type for air suction purposes only.

It should be noted that a cover 32 for covering cables or a connecting clamp 31 is attached to an upper portion of the connecting pipe 3, similarly to the prior art.

Further, a side of suction inlet 33 of the connecting pipe 3 for connecting the other connecting pipe 3 or the suction nozzle for floors 4 is so arranged that its partition portion (inner wall portion of inner cylindrical portion 3*a*) 34 for separating the suction air passage A and the exhaust air passage B is spaced inwardly from the suction inlet end by a specified distance.

On the other hand, the other end of the connecting pipe 3 is formed to assume a somewhat smaller diameter than compared to the corresponding side of the suction inlet 27 of the grip portion 24 or the suction inlet 33 of the connecting pipe 3 such that the outer cylindrical portion 3*b* fits to an inner periphery on the side of the suction inlets 27, 33, while an extrusion 35 is further formed at an upper portion for engaging with clamps 29, 31. By fitting the connecting pipe 3 to the grip portion 24 or the other connecting pipe 3 such that the clamps 29, 31 and the extrusion 35 engage with each other, the end portion of the inner cylindrical portion 3*a* is made to closely contact aperture end edges 28*a*, 34*a* of partition portions 28, 34 which are formed to be concave towards the side of the suction inlets 27, 33.

It should be noted that while joint tubes 4*a*, 4*b* of the suction nozzle for floors 4 are arranged to assume a concentric circular double structure, fitting portions with the connecting pipes 3 are formed similar to the above arrangement.

At the time of using the vacuum cleaner of the above arrangement, through suction of the motor fan 5, air intermingled with dust sucked through the suction nozzle for floors 4 is taken into the vacuum cleaner main body 1 by passing through the suction air passage A of the connecting pipe 3 and the suction air passage A of the hose 2. Within the main body 1, air which has been purified by being eliminated of dust by the paper pack 7 and further through the minute dust filter 8 is sucked by the motor fan 5 and cools its motor 5*a*.

A part of the air exhausted from the motor fan 5 is discharged to the exterior through the exhaust outlet 11 of the main body 1, and the rest circumfluently flows from the exhaust air passage B of the main body 1 to the suction nozzle for floors 4 by passing through the exhaust air passage B of the hose 2 and the exhaust air passage B of the connecting pipe 3. Further, together with dust which has been whirled up by this exhaust air, it is again circulated to the suction air passage A of the connecting pipe 3.

Now, it is the case with general vacuum cleaners of floor moving type that cleaning can be performed, besides cleaning using the ordinary suction nozzle for floors 4, by using a tip of the connecting pipe 3 or a tip of the grip 24 when performing cleaning of a small amount of dust.

When performing cleaning in the above manner by using a vacuum cleaner of exhaust circumfluently flowing type, there might be a fear that dust to be sucked is adversely blown off by the blown out exhaust air. However, joint arrangements of the above-described tip of the connecting pipe 3 (suction inlet 33) or the tip of the grip portion 24 (suction inlet 27) have been devised in the present embodiment so that the above-described inconveniences are prevented from occurring.

Figure 8:
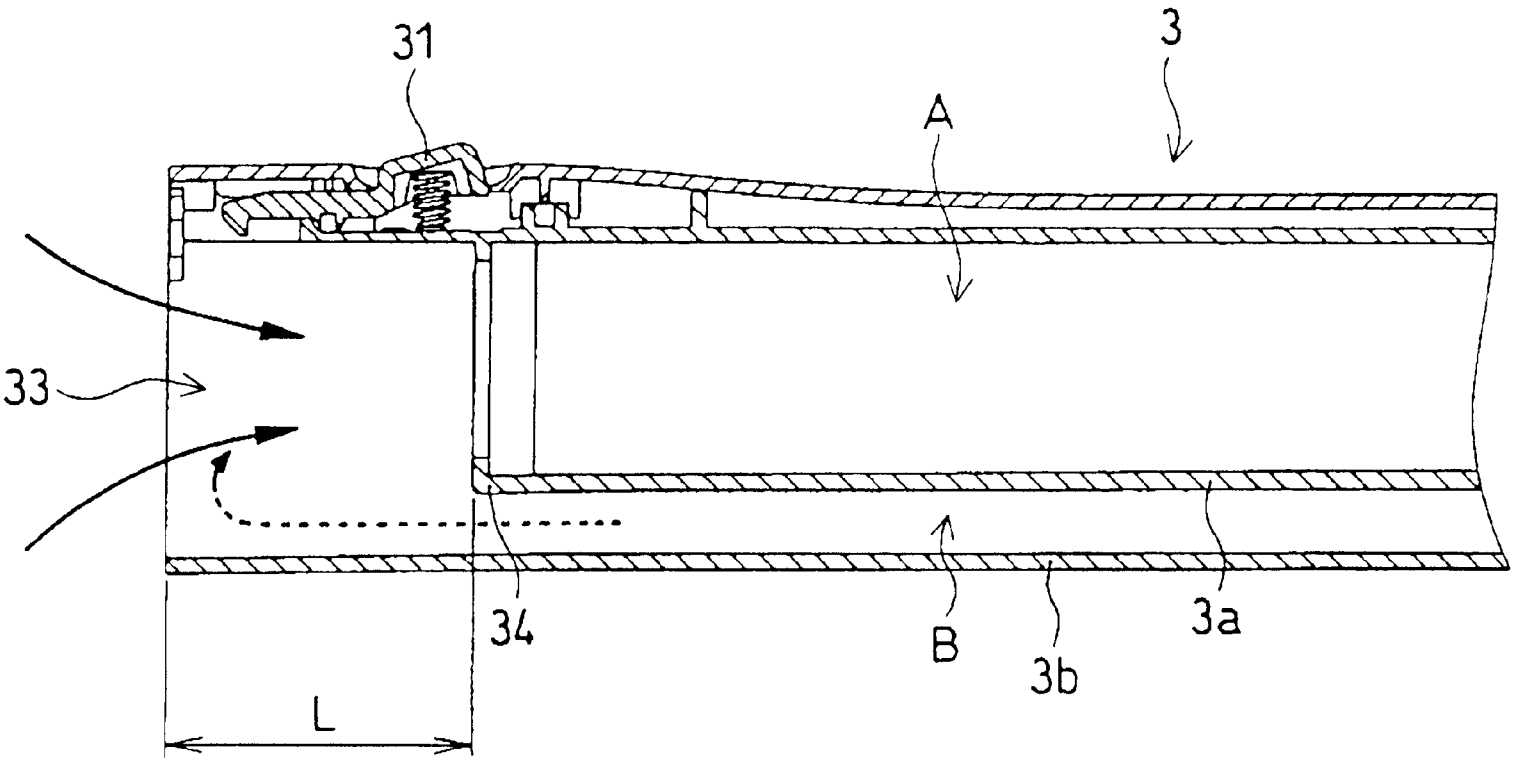
FIG. 8 is a view for explaining a way for solving inconveniences at the time of performing cleaning with a pipe tip end according to the above embodiment.

That is, while it applies similarly to the connecting pipe 3 as well as to the grip portion 24, the following explanations are based on the case with the connecting pipe 3 with reference to FIG. 8 wherein the exhaust flow discharged from the exhaust air passage B naturally comprises a part of air exhausted from the motor fan 5 which has been flown circumfluently, so that the suction flow as represented by the solid line arrow becomes stronger than the exhaust flow as represented by the dotted line arrow. Thus, as represented by the dotted line arrow, the exhaust flow is drawn in by a strong air of the suction flow as represented by the solid line arrow between a distance L at a fitting portion of the pipe so that it is sucked to the side of the suction air passage A.

In this manner, by making the partition portion 34 of the suction air passage A and the exhaust air passage B between the distance L which is required for fitting the pipes be concave, blowing off of dust owing to exhaust air can be eliminated. It should be noted while the distance L is approximately 40 mm in the present embodiment in view of pipe fitting and velocity of sucked and exhausted air, the present invention is not limited to this value.

As explained above, since it can be realized for light-weighted and slim-sized connecting pipes 3 through which suction air passage A and exhaust air passage B extend and for eliminating blowing off at the time of performing cleaning using the tip of the pipe 3 or the tip of the grip portion 24 in the vacuum cleaner of exhaust circumfluently flowing type according to the present embodiment, advantages of an exhaust circumfluently flowing mechanism can be practically materialized.

That is, by making a part of exhaust air circumfluently flow, exhaust air blown out to the exterior is decreased and weakened so that there can be effectively restricted that dust within a room is whirled up while performing cleaning.

Further, since there is air which is repeatedly circulated, the exhaust air to be discharged to the exterior is further purified by using the paper pack 7, minute dust filter 8 or the like. Further, since the flow velocity of exhaust air blown out from the exhaust outlet 11 becomes also smaller, filtering efficiencies of the exhaust filter 10 can be improved and purification of exhaust air can be performed in a more effective manner. This also is in line with the tendency towards cleanliness in these years.

Figure 9A:
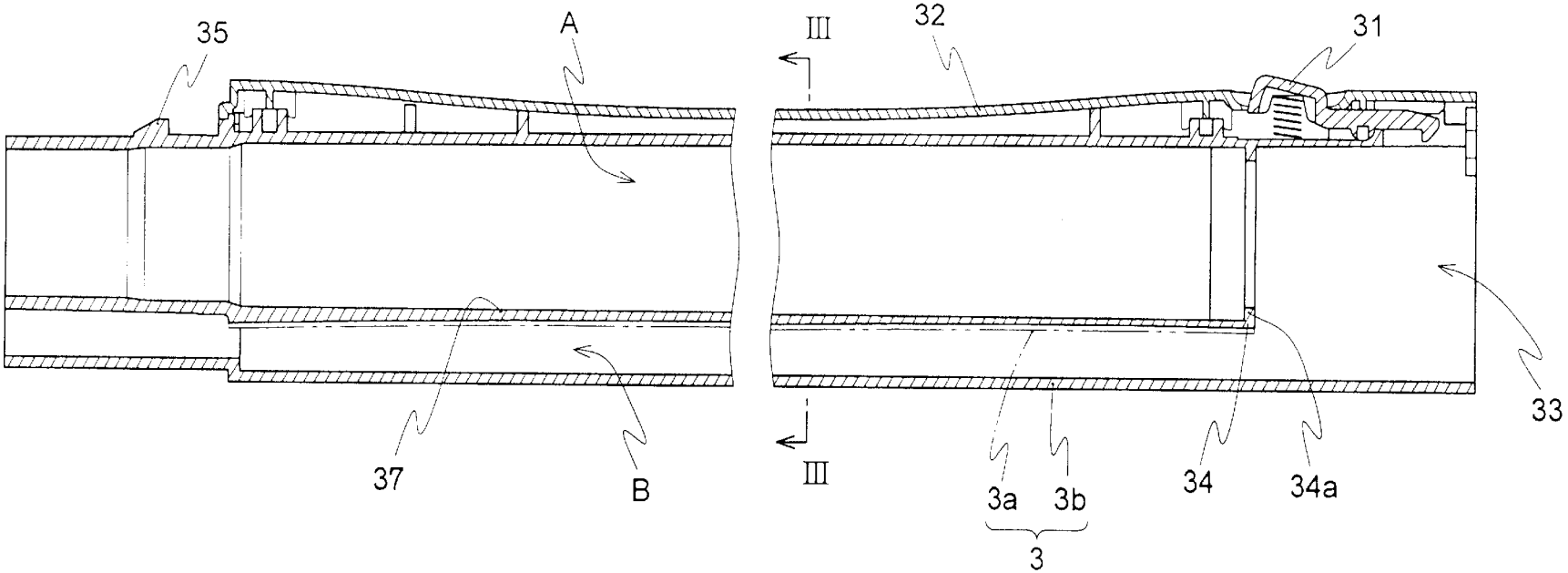
FIGS. 9(*a*) and 9(*b*) are views showing an arrangement of a connecting pipe according to another embodiment of the present invention wherein FIG. 9(*a*) is a longitudinal sectional view and FIG. 9(*b*) a sectional view taken along the line III—III.
Figure 9B:
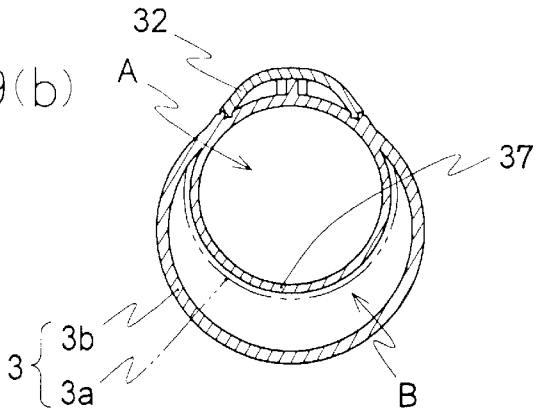

FIG. 9 is a structural view showing a connecting pipe 3 according to another embodiment of the first invention wherein identical references numerals are used for portions which are identical or equivalent to those of the previous embodiment.

In the illustrated embodiment, the wall thickness of partition portion 37 for separating exhaust air passage B and suction air passage A of the inner cylindrical portion 3*a* which is located inside of the outer cylindrical portion 3*b* and does not play a large role in terms of strength is made thinner than an outer wall portion of the outer cylindrical portion 3*b* from the two-dot broken like to the solid line as shown in the drawing so as to make heat of the exhaust air in the exhaust air passage B easier transmissible to the air passage air suction air passage A.

With this arrangement, heat exchange from the exhaust air passage B to the suction air passage A is promoted and increase in temperature of the outer surface of the outer cylindrical portion 3*b* can be restricted, so that the temperature does not increase to an extent with which the user would feel incompatibility, and utility thereof can be improved. Further, since the wall thickness of the partition portion 37 separating the suction air passage A from the exhaust air passage B is formed to be small, it is enabled to achieve for a light-weighted arrangement while preventing decrease in strength to the utmost.

The reason for employing the conduit hose 2*a* on the inner side in the embodiment shown in FIGS. 1 to 8 is based on the idea that no coil wiring is necessary at the inner side owing to the outer one-layer and two-wiring hose 2*b* incorporating coil wiring 21. Since the conduit hose 2*a* does not incorporate therein coil wiring 21 unlike the one-layer and two-wiring hose 2*b*, there are presented advantages that it is light-weighted and restorable even if it is erroneously treaded on, leaving no deformations as it is the case with the one-layer and two-wiring hose 2*b*. In terms of expansion characteristic, the one-layer and two-wiring hose 2*b* wherein the coil wiring 21 is incorporated in a tube made of, for instance, PVC resin, is superior than the conduit hose 2*a* which is formed by molding resin in a bellow-like manner. In the present embodiment, the one-layer and two-wiring hose 2*b* is formed of semitransparent PVC resin or the like.

In this manner, in view of the fact that the coil wiring 21 is required only at either side, there is employed the one-layer and two-wiring hose 2*b*, which is similar to those of the prior art for suction purposes only though being formed to be semitransparent, on the outer side and the light-weighted conduit hose 2*a* on the inner side, so that a light-weighted arrangement of the double hose 2 can be achieved while wiring arrangements to the hose grip portion 24 for performing operations at hand as will be described later and to the vacuum cleaner main body 1 remain as conventional.

Further, in case the above-described double hose 2 is erroneously treaded on, the inner conduit hose 2*a* will restore without leaving any deformations so that the inner conduit hose 2*a* will be in order as long as the outer one-layer and two-wiring hose 2*b* is not deformed, while in case the outer one-layer and two-wiring hose 2*b* is deformed, the inner conduit hose 2*b* will be cracked, either. In this manner, the condition of the inner hose can be recognized from the external appearance of the double hose 2 so that there can be prevented for drawbacks that the plugging of dust occurs without noticing abnormalities of the inner hose.

Further, since the one-layer and two-wiring hose 2*b* which is superior in expansion characteristic is arranged at the outer side, pliability of the double hose 2 can be maintained even when being bent.

Further, by making the inner conduit hose 2*a* to be opaque and the outer one-layer and two-wiring hose 2*b* to be semitransparent, it can be achieved for improvements in external appearance owing to demanding effects of design, and despite the thicker structure of the double hose 2 than compared to an ordinary hose, the semitransparent outer one-layer and two-wiring hose 2*b* makes the inner conduit hose 2*a* visible so that the entire hose appears to be relatively thin. Further, since the inner conduit hose 2*a* through which dust passes is made to be opaque and the outer one-layer and two-wiring hose 2*b* through which air containing no dust after dust-collection passes to be semitransparent, dust which adheres to the inner surface of the inner conduit hose 2*a* cannot be seen and the inner surface of the outer one-layer and two-wiring hose 2*b* will not be stained, so that the external appearance of the double hose 2 will not be harmed. Further, since the condition of the inner conduit hose 2*a* can be observed from the exterior, there can similarly prevented for drawbacks that the plugging of dust occurs without noticing abnormalities of the inner hose.

Figure 4:
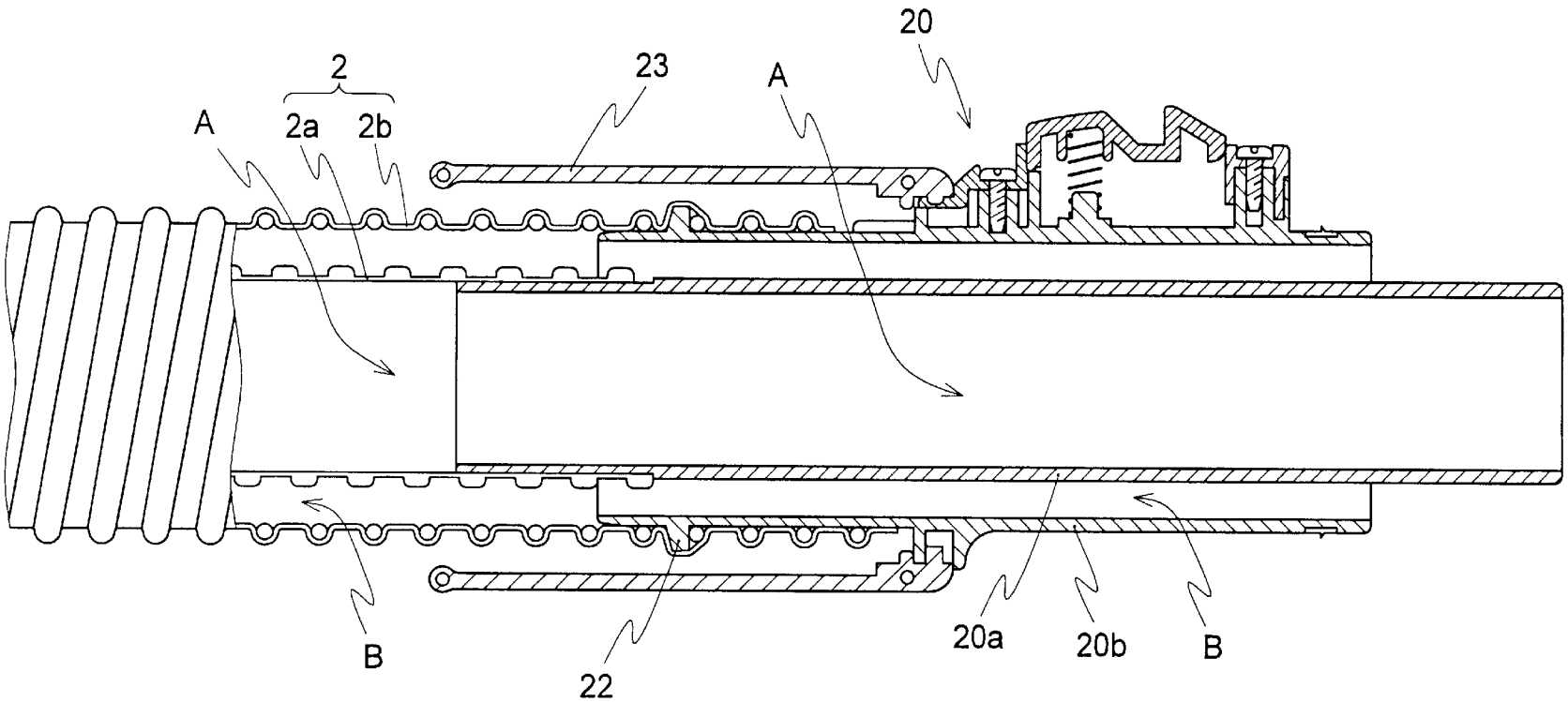
FIG. 4 is an enlarged sectional view of the hose joint portion shown in FIG. 1.

Further, as shown in FIG. 4, the only hose which is screwed into the rib 22 is the one-layer and two-wiring hose 2*b* which is located outside and is relative easy to be installed, and the conduit hose 2*a* which is located inside and is hard to be installed just needs to be inserted in a straight manner and adhered so that this can be easily performed. Further, at the time of installing the inner conduit hose 2*a*, the hose-installing end of the inner connecting pipe extends beyond than the hose-installing end of the outer connecting pipe 20*b* so that the outer connecting pipe 20*b* will be of no hindrance and installation can be easily performed. Therefore, assembling processes of the double hose 2 can be further simplified.

Similarly, as shown in FIG. 7, the only hose which is screwed into the rib 25 is the one-layer and two-wiring hose 2*b* which is located outside and is relative easy to be installed, and the inner conduit hose 2*a* just needs to be inserted in a straight manner and adhered so that this can be easily performed. Further, at the time of installing the inner conduit hose 2*a*, the hose-installing end of the inner connecting pipe extend beyond the hose-installing end of the outer connecting pipe 24*b* so that the outer connecting pipe 24*b* will be of no hindrance and installation can be easily performed. Therefore, assembling processes of the double hose 2 can be further simplified.

As explained so far, since there can be realized for a light-weighted hose 2 through which suction air passage A and exhaust air passage B extend and simplified assembling process of the hose 2, and for light-weighted and slim-sized connecting pipes 3 in the vacuum cleaner of exhaust circumfluently flowing type according to the present embodiment, advantages of an exhaust circumfluently flowing mechanism can be practically materialized.

Figure 10:
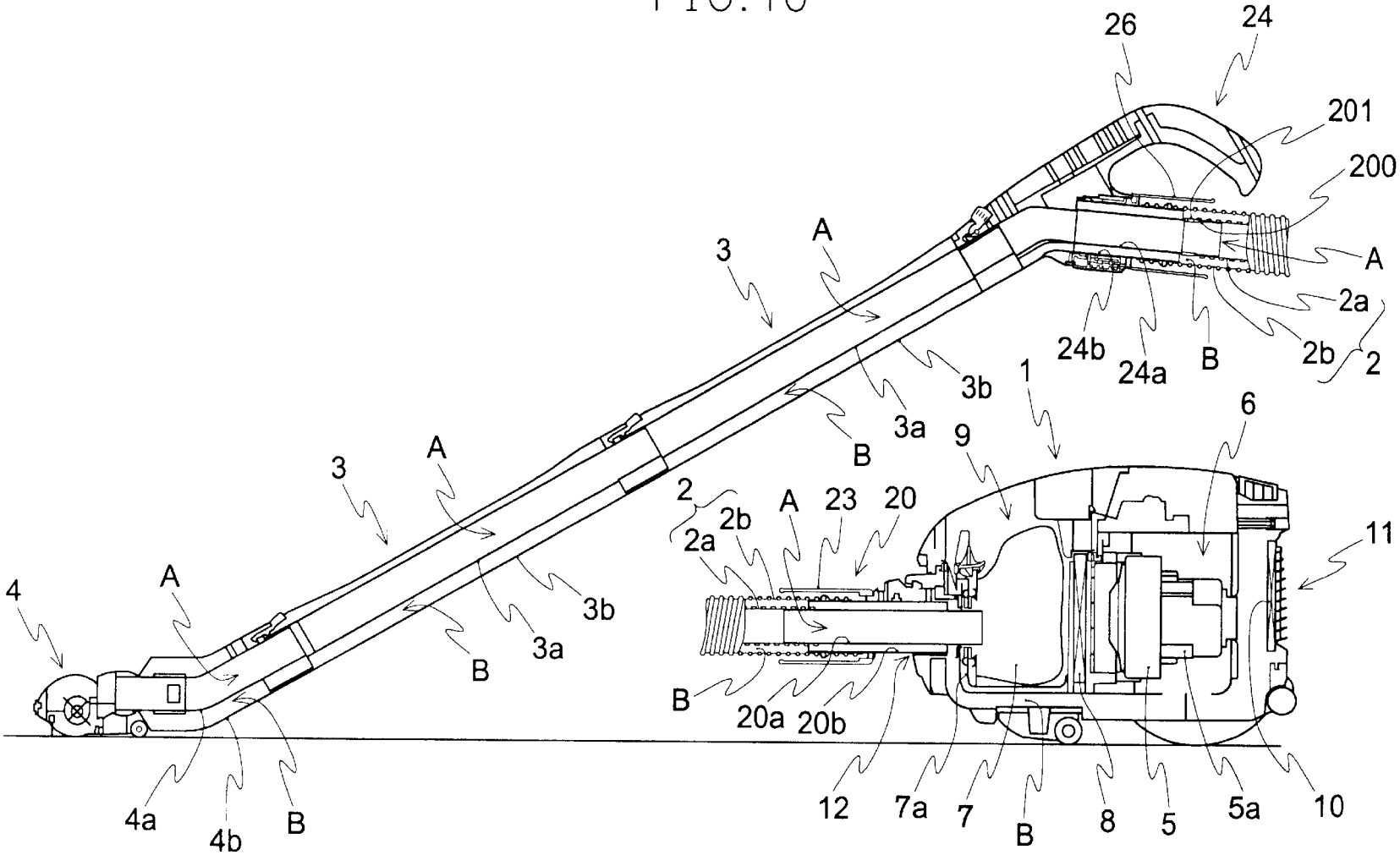
FIG. 10 is an overall structural view showing another embodiment wherein the present invention is applied to a general vacuum cleaner of floor moving type, while an intermediate portion of a hose is omitted in the drawing for purpose of convenience.
Figure 11:
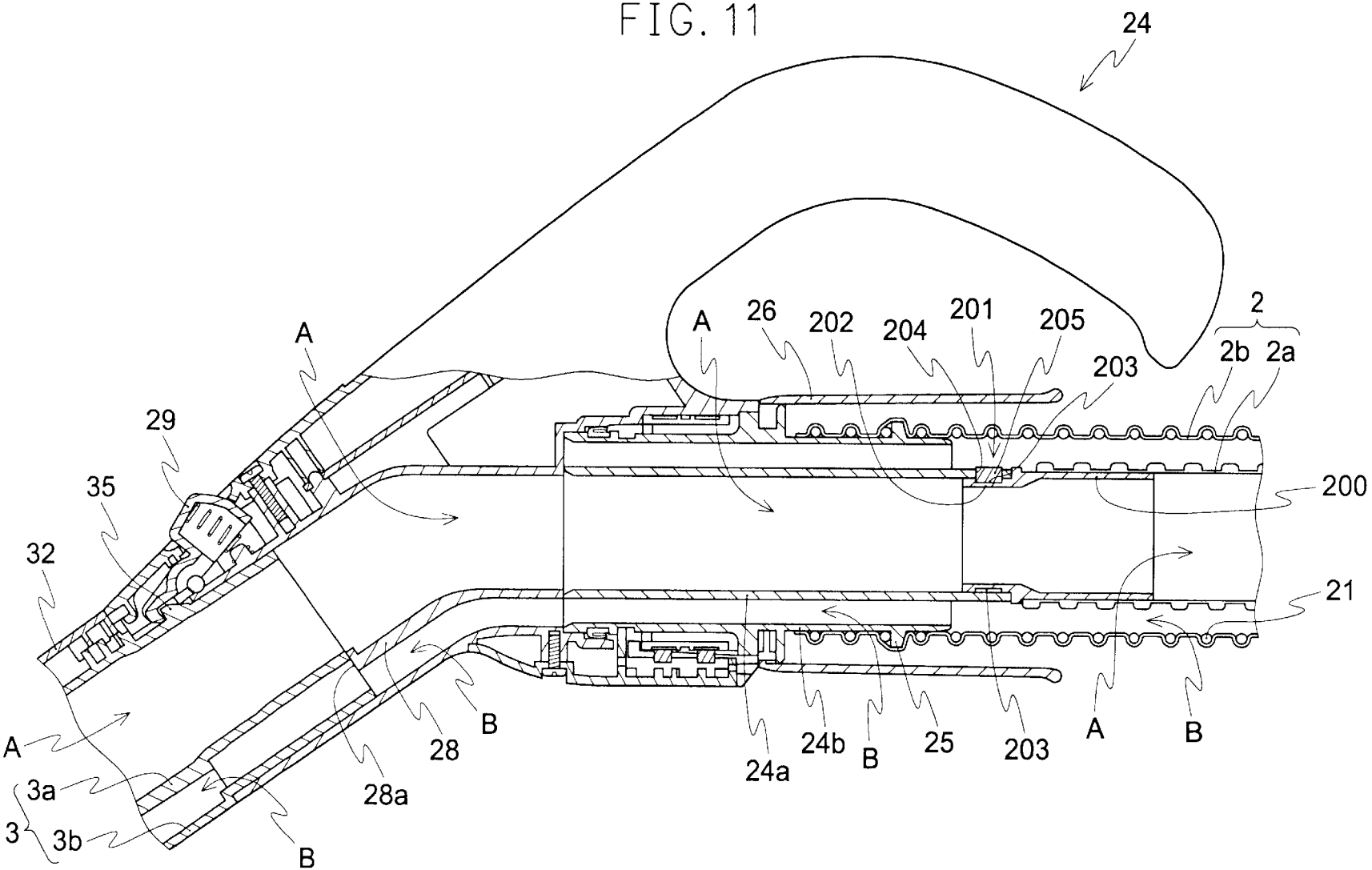
FIG. 11 is an enlarged view of a hose grip portion shown in FIG. 10.
Figure 12A:
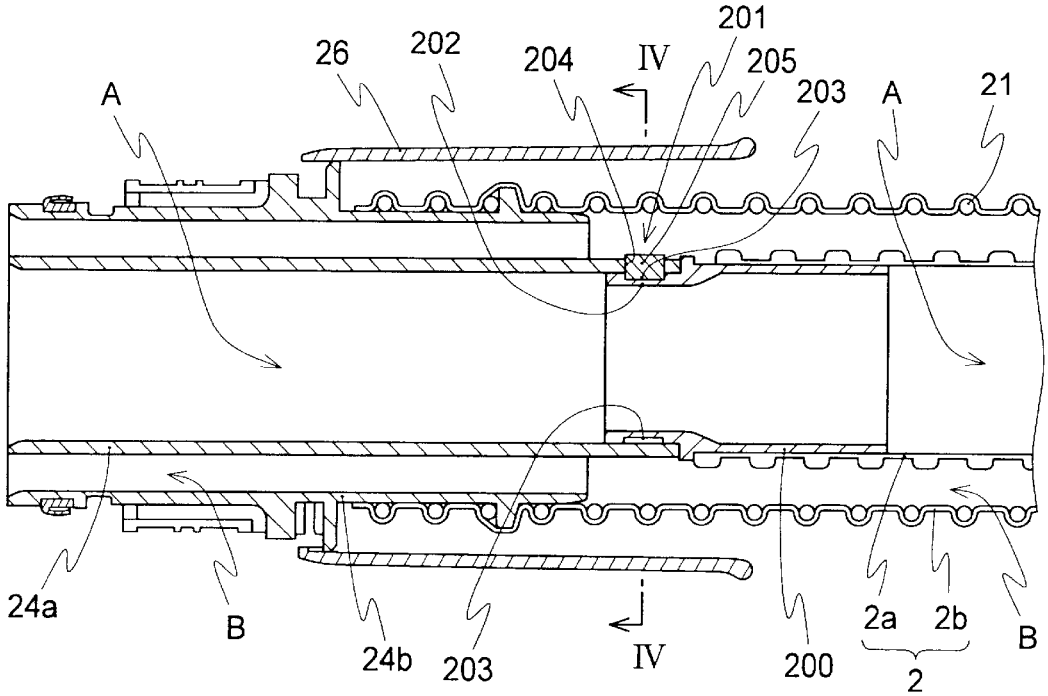
FIGS. 12(*a*) and 12(*b*) are structural views showing a structure for attaching a hose to the connecting pipe of the hose grip portion shown in FIG. 11 wherein FIG. 12(*a*) is a longitudinal sectional view, and FIG. 12(*b*) a sectional view taken along the line IV—IV of FIG. 12(*a*).
Figure 12B:
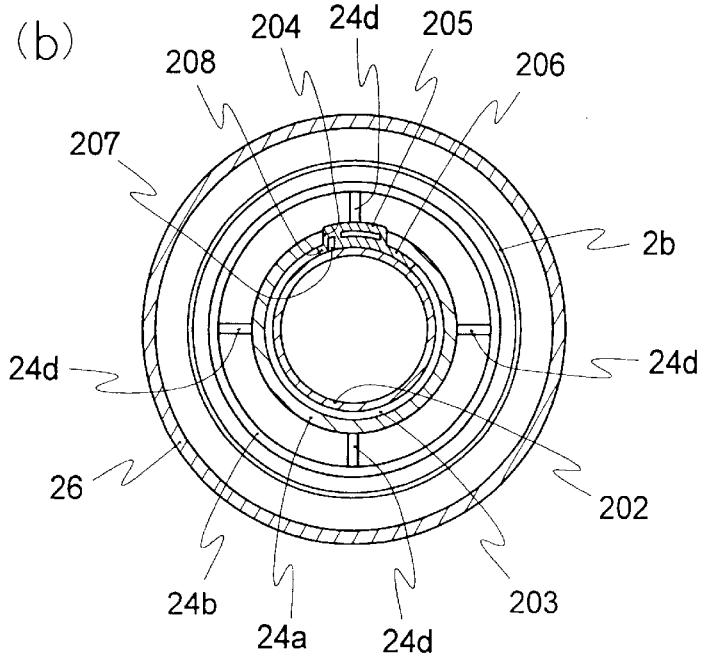

Next, FIGS. 10 to 12 are structural views for showing another embodiment of the second invention wherein identical references numerals are used for portions which are identical or equivalent to those of the previous embodiment.

The illustrated embodiment, as shown in FIG. 10 or FIG. 11, comprises an auxiliary pipe 200 that is attached to one end (grip portion 24 side) of the conduit hose 2*a* which is the inner hose and that is tightly fitted to the inner hose-installing end of the connecting pipe 24*a* on the grip portion 24 side, and a slip off-preventing mechanism 201 for the tightly fitted auxiliary pipe 200.

As shown in FIG. 11 or FIG. 12, the slip off-preventing mechanism 201 is composed of an annular grove 203 formed at an outer periphery of a fitting portion 202 of the auxiliary pipe 200 and a C ring member 205 which is attached through an installing hole 204 formed at the inner hose-installing end of the connecting pipe 24*a* for engaging with the annular groove 203 of the auxiliary pipe fitting portion 202. The slip off-preventing mechanism serves as not only performing slip off-preventing function but also connecting the auxiliary pipe 200 installed at the conduit hose 2*a* and the inner hose-installing end of the connecting pipe 24*a* in a slidable manner in a peripheral direction.

The C ring member 205 is installed in such a manner that a side of one long piece 206 shown in FIG. 12(*b*) is inserted from the installing hole 204 to the fitting groove 203 while a claw 208 which is formed at the other side to be elastic through a notch 207 is pushed into the installing hole 204, thereby the claw 208 is caught at the end edge of the installing hole 204 so that it does not come off. It should be noted that in FIG. 12(*b*), numeral 24*d* denotes a rib which connects the inner and outer connecting pipes 24*a*, 24*b* for forming a concentric circular double structure.

Assembling processes (steps) for the double hose 2 according to the present embodiment as it has been improved in the above manner will be as follows.

First, the auxiliary pipe 200 is attached and adhered to one end of the inner conduit hose 2*a* while the other end of the conduit hose 2*a* is attached and adhered to an extruding end of the inner connecting pipe 20*a* of the joint portion 20 which is inserted to the side of the vacuum cleaner main body 1, similarly to the previous embodiments, and the outer one-layer and two-wiring hose 2*b* is further attached and fixed by screwing it to the rib 22 formed at the outer surface of the outer connecting pipe 20*b*. In this manner, assembly of the joint portion 20 at the main body side is completed.

Next, as described above, the auxiliary pipe 200 which is installed to one end of the conduit hose 2*a* as explained above is tightly fitted to the inner hose-installing end of the connecting pipes 24*a*, 24*b* which are attached to the hose grip portion 24, and the C ring member 205 is fitted to the installing hole 204 formed at the inner hose-installing end in the above-described manner. In this manner, the conduit hose 2*a* is installed at the inner connecting pipe 24*a* in a slidable manner. Similarly to the previous embodiments, the one-layer and two-wiring hose 2*b* is attached and fixed by being screwed to the rib 25 formed at the outer surface of the outer connecting pipe 24*b*.

At this time, since the other end side of the double hose 2 has been already attached and fixed to the joint portion 20 at the main body side, the inner conduit hose 2*a* will be rotated in the same direction accompanying the screwing of the one-layer and two-wiring hose 2*b*; however, since the conduit hose 2*a* of the present embodiment is installed at the inner connecting pipe 24*a* in a slidable manner as noted above, no torsions will be caused in the conduit hose 2*a*.

As explained so far, the present embodiment makes it possible to perform installing of the inner conduit hose 2*a* to the connecting pipe 24*a* in quite an easy manner while eliminating torsions, and there can be omitted for measures such as twisting the conduit hose 2*a* in an opposite direction in view of torsion, so that assembling processes for the double hose 2 can be extremely simplified.

It should be noted that while the above-described measures have been devised at the side of the grip portion 24 of the conduit hose 2*a* assuming that the side of the grip portion 24 is assembled later, in case the side of the joint portion 20 of the main body is to be assembled later, such measures might be performed for the main body joint portion 20 for the conduit hose 2*a*. Further, while sufficient effects can be achieved by performing these devises on the side which is hard to be assembled, in case the above measures are performed at both sides, assembly can be further simplified.

Further, while the one-layer and two-wiring hose 2*b* incorporating therein a coil wiring 21 having conductive and shape-retaining characteristics is employed as the outer hose, the present invention is not limited to this arrangement, and the invention is also applicable to a hose referred to as a two-layer and four-wiring hose incorporating therein signal wiring and electric power wiring (for power brushes); a hose incorporating conductive wiring (e.g. copper wiring) which do not present shape-retaining characteristics so much while the hose itself is made to assume shape-retaining characteristics; or a hose incorporating a coil-like member (shape-retaining means) made of metal or synthetic resin and having shape-retaining characteristics.

Moreover, while the outer hose (one-layer and two-wiring hose 2*b*) is made to be semitransparent, effects similar to the above-described ones can be achieved if it exhibits transparent characteristics, regardless of whether it is semitransparent or transparent.

As explained so far, the first invention is so arranged that the pipe is composed of an inner cylindrical portion having a substantially circular section and forming the suction air passage and an outer cylindrical portion a part of which is uniformly formed with the inner cylindrical portion and which covers the inner cylindrical portion to form the exhaust air passage. With this arrangement, there can be achieved for a light-weighted and slim-sized arrangement of the pipe through which the suction air passage and the exhaust air passage extends without the fear of dust plugging, and a vacuum cleaner of exhaust circumfluently flowing type can be easily put into to practice.

By arranging the exhaust air passage of the pipe to assume a substantially crescent section and the outer cylindrical portion of the pipe to assume a substantially circular section, no incompatibilities are recognized when compared to conventional ones for suction purposes only, and substantially identical shapes and operatability can be achieved.

A wall thickness of a partition portion for separating the suction air passage and the exhaust air passage of the pipe is formed to be smaller than an outer wall portion. With this arrangement, heat exchange from the exhaust air passage to the suction air passage is promoted and increase in temperature of the outer surface of the outer cylindrical portion can be restricted, so that the temperature does not increase to an extent with which the user would feel incompatibility, and utility can be further improved. Further, since the wall thickness of the partition portion that separates the suction air passage from the exhaust air passage is formed to be small, it is enabled to achieve for a light-weighted arrangement while preventing decrease in strength to the utmost.

The partition portion for separating the suction air passage and the exhaust air passage at a suction inlet side of the pipe or at a suction inlet of a grip portion of the hose is indented in a depth direction by a specified distance. With this arrangement, exhaust flow is sucked in by the suction flow and is prevented from being blown out at the time of performing cleaning using the tip end of the pipe or the tip end of the grip portion so that cleaning in such manner can be performed without any inconveniences.

According to the second invention, the hose is arranged to be of a double structure, and a flexible hose incorporating therein conductive wiring is used as an outer hose for forming the exhaust air passage while a flexible hose incorporating no conductive wiring is used as an inner hose for forming the suction air passage. With this arrangement, a light-weighted arrangement of the double hose through which the suction air passage and the exhaust air passage extend can be achieved while wiring arrangements to the hose grip portion for performing operations at hand or to the vacuum cleaner main body remain as conventional owing to the omission of conductive wiring for the inner hose. Further, in case the double hose is erroneously treaded on, deformations are apt to be left at the outer hose since it incorporates therein the conductive wiring while deformations are hardly left at the inner conduit hose incorporating therein no conductive wiring, so that the inner conduit hose will be in order as long as the outer one-layer and two-wiring hose is not deformed. On the other hand, in case the outer one-layer and two-wiring hose is deformed, the inner conduit hose will be cracked, either. In this manner, the condition of the inner hose can be recognized from the external appearance of the double hose so that there can be prevented for inconveniences that abnormalities in the inner hose are not noticed to result in occurrence of the plugging of dust.

Further, by making the hose to be of a double structure, by employing a flexible hose incorporating therein a shape-retaining means as an outer hose for forming the exhaust air passage, and by employing a flexible hose incorporating no shape-retaining means as an inner hose for forming the suction air passage, there can be achieved for a light-weighted structure for the double hose through which the suction air passage and the exhaust air passage extend since no shape-retaining means are incorporated in the inner hose, and a vacuum cleaner of exhaust circumfluently flowing type can be easily put into practice.

Further, the inner hose-installing end of a connecting pipe of double structure, which is used for attaching one end of the hose of double structure to a hose-inserting inlet of the vacuum cleaner main body and the other end thereof to a hose grip portion, is made to extrude outwardly than an outer hose-installing end. With this arrangement, at the time of installing the inner conduit hose which is difficult to be installed, its hose-installing end is extruding more outside than the hose-installing end of the outer connecting pipe so that the outer connecting pipe will be of no hindrance and installation can be easily performed, and assembling processes of the double hose can be simplified.

There are arranged, in addition to a connecting pipe of double structure, which is used for attaching one end of the hose of double structure to a hose-inserting inlet of the vacuum cleaner main body and the other end thereof to a hose grip portion, an auxiliary pipe which is installed to at least one end of the inner hose and which is tightly fitted to a corresponding inner hose-installing end of the connecting pipe; and a slip off-preventing mechanism for the tightly fitted auxiliary pipe. With this arrangement, installation of the inner hose which assembly is more difficult can be extremely simplified.

Further, there are arranged, as the slip off-preventing mechanism, an annular groove which is formed at an outer periphery of a fitting portion of the auxiliary pipe, and an engaging member which is attached to the inner hose-installing end of the connecting pipe for engaging with the annular groove, wherein the auxiliary pipe attached to the inner hose and the inner hose-installing end of the connecting pipe are connected in a slidable manner in a peripheral direction. With this arrangement, no torsions will be generated in the inner hose even when the outer hose is installed in a screwing manner, so that measures such as twisting to the inner hose in the opposite direction in view of torsion can be omitted and assembling processes of the double hose can be extremely simplified.

By making the inner hose to be opaque while the outer hose is made to be transparent, there can be achieved for improvements in external appearance owing to demanding effects of design, and despite the thicker structure of the double hose than compared to an ordinary hose, the outer hose makes the inner hose visible owing to the transparent characteristics thereof so that the entire hose appears to be relatively thin. Further, since the inner conduit hose through which dust passes is made to be opaque and the outer one-layer and two-wiring hose through which air containing no dust after dust-collection passes to be semitransparent, dust which adheres to the inner surface of the inner conduit hose cannot be seen and the inner surface of the outer one-layer and two-wiring hose will not be stained, and the external appearance of the double hose will not be harmed. Further, since the condition of the inner conduit hose can be observed from the exterior, there can similarly prevented for drawbacks that the plugging of dust occurs without noticing abnormalities of the inner hose.

What is claimed is:

1. A vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow, characterized in that the hose is arranged to be of a double structure, and in that a flexible hose incorporating therein conductive wiring is used as an outer hose for forming the exhaust air passage, while a flexible hose incorporating no conductive wiring is used as an inner hose for forming the suction air passage.

2. A vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow, characterized in that the hose is arranged to be of double structure, and in that a flexible hose incorporating therein a shape-retaining means for retaining the substantially cylindrical shape of the hose is used as an outer hose for forming the exhaust air passage, while a further hose incorporating no shape-retaining means is used an an inner hose for forming the suction air passage.

3. The vacuum cleaner of claim 1, wherein an inner hose-installing end of a connecting pipe of double structure, which is used for attaching one end of the hose of double structure to a hose-inserting inlet of the vacuum cleaner main body and the other end thereof to a hose grip portion, is made to extend beyond an outer hose-installing end.

4. The vacuum cleaner of claim 1, wherein the inner hose is made to be opaque while the outer hose is made to be transparent.

5. The vacuum cleaner of claim 2, wherein an inner hose-installing end of a connecting pipe of double structure, which is used for attaching one end of the hose of double structure to a hose-inserting inlet of the vacuum cleaner main body and the other end thereof to a hose grip portion, is made to extend beyond an outer hose-installing end.

6. The vacuum cleaner of claim 2, wherein the inner hose is made to be opaque while the outer hose is made to be transparent.

7. A vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow, characterized in that the pipe is composed of an inner cylindrical portion having a substantially circular section and forming the suction air passage, and an outer cylindrical portion, a part of which is uniformly formed with the inner cylindrical portion, which covers the inner cylindrical portion to form the exhaust air passage, wherein a wall thickness of a partition portion for separating the air suction air passage and the exhaust air passage of the pipe is formed to be smaller than an outer wall portion of the pipe.

8. A vacuum cleaner wherein a hose, a pipe and a suction nozzle, which are connected to a vacuum cleaner main body incorporating therein a motor fan, are formed with a suction air passage as well as an exhaust air passage for making air exhausted from the motor fan circumfluently flow, characterized in that the pipe is composed of an inner cylindrical portion having a substantially circular section and forming the suction air passage, and an outer cylindrical portion, a part of which is uniformly formed with the inner cylindrical portion, which covers the inner cylindrical portion to form the exhaust air passage, wherein a partition portion for separating the suction air passage and the exhaust air passage at at least one of a suction inlet end of the pipe and a suction inlet end of a grip portion of the hose is spaced inwardly from the respective end by a specified distance.

* * * * *